US007762428B2

(12) United States Patent
Scheugenpflug

(10) Patent No.: US 7,762,428 B2
(45) Date of Patent: Jul. 27, 2010

(54) EMPTYING DEVICE

(76) Inventor: Erich Scheugenpflug, Gewerbepark 23, 93333 Neustadt/Donau (DE)

( * ) Notice: Subject to any disclaimer, the term of this patent is extended or adjusted under 35 U.S.C. 154(b) by 776 days.

(21) Appl. No.: 11/506,032

(22) Filed: Aug. 17, 2006

(65) Prior Publication Data

US 2007/0039978 A1 Feb. 22, 2007

(30) Foreign Application Priority Data

Aug. 19, 2005 (DE) ..... 10 2005 039 359
Oct. 18, 2005 (DE) ..... 10 2005 049 805

(51) Int. Cl.
*B65D 83/76* (2006.01)
*B67D 7/70* (2010.01)

(52) U.S. Cl. ..... 222/53; 222/152; 222/259; 222/387

(58) Field of Classification Search ..... 222/53, 222/152, 189.09, 256–259, 387
See application file for complete search history.

(56) References Cited

U.S. PATENT DOCUMENTS 1,936,857 A * 11/1933 Reisdorf ..... 222/152
2,221,763 A * 11/1940 Ginter ..... 222/259
2,280,708 A * 4/1942 Klein et al. ..... 222/259
2,385,579 A 9/1945 King et al.
2,630,248 A * 3/1953 Hinz ..... 222/259
3,412,903 A * 11/1968 Van Riper, Jr. et al. ..... 222/258
3,982,669 A * 9/1976 Moore ..... 222/389
4,592,491 A * 6/1986 Chollet ..... 222/258
4,630,760 A * 12/1986 Wold ..... 222/387
4,635,820 A * 1/1987 Marshall ..... 222/259
5,125,785 A * 6/1992 Langen et al. ..... 222/387
5,248,069 A * 9/1993 Consaga et al. ..... 222/389
5,257,723 A * 11/1993 Bagung ..... 222/261
6,056,153 A * 5/2000 Inoue ..... 222/387
6,422,430 B1 * 7/2002 Ito ..... 222/386

FOREIGN PATENT DOCUMENTS

FR 2544699 A * 10/1984
FR 2742138 A1 * 6/1997

OTHER PUBLICATIONS

Machine Translation of FR 2544699 A.*
Machine Translation of FR 2742138 A1.*

* cited by examiner

*Primary Examiner*—Kenneth Bomberg
(74) *Attorney, Agent, or Firm*—Head, Johnson & Kachigian, P.C.

(57) ABSTRACT

For bubble free emptying of pasteous substances from drum-shaped containers these are pumped out through a drum follower plate placed onto the paste. In a refinement, the drum follower plate is provided hollow with a lower grid plate and before the beginning of the pumping out process through evacuation of the hollow intermediary space air, possibly present under the drum follower plate, is sucked from there into the intermediary space, so that the pump scooping from below the grid plate only feeds pasteous material right from the beginning.

36 Claims, 9 Drawing Sheets

EMPTYING DEVICE

CROSS-REFERENCES TO RELATED APPLICATIONS

This application claims priority to German Patent Application No. 102005039359.4 filed 19 Aug. 2005 which claims priority to German Patent Application No. 102005049805.1 filed 18 Oct. 2005.

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention regards an emptying device for highly viscous materials.

Materials that are so viscous that, due to gravity, they do not let enclosed air bubbles exit upwards, for instance in large containers, or the material does not continue to slide to the deepest spot any more, pose considerable difficulties when this highly viscous material is to be fed out of a container e.g. through a pipe connection, so that no air bubbles are fed in the feed line, since this may cause problems in a subsequent application, e.g. when automatically applying a line of sealant or glue material.

So far such pastes were transported and delivered in cylindrical buckets or drums, which were emptied by the user through pressing a so-called drum follower plate onto the top surface of the paste with the drum opened, wherein a pump, e.g. a scoop piston pump was connected tight to a central pass through in the drum follower plate (drum follower pump).

Air bleeding hereby causes problems, especially through initially pressing on the follower plate. Rises in the surface of a paste should be flattened and enclosed air, initially present between the surface of the paste and the plate, should be pressed out through the central opening or evacuated actively.

The design of the pump hereby is of minor importance. Instead of a scoop cone pump, also eccentrical helix pumps and other kinds of pumps with respective specific advantages and disadvantages, in particular when feeding pasteous materials, can be used.

One disadvantage is that between the plate and the surface of a paste, but also in the interior of the paste completely enclosed by it, air filled cavities can be present which, due to lack of connection to the outlet opening in the plate, do not empty and only reach a feed out line during the emptying process.

Further disadvantages are as follows:

- an user always had to empty a part of the material in which air enclosures were to be suspected at the beginning of an emptying process,
- due to wrong setting of the contact pressure, the follower plate was pressed to the bottom of the material in the container, and the material was squeezed past a circumferential seal of the plate on the side; or

- due to insufficient contact pressure the pump fed air, and, therefore, an undisturbed emptying of the containers strongly depended on an experienced operator.

BRIEF SUMMARY OF THE INVENTION

It is an objective of the invention to provide an emptying device and an evacuation process enabling a reliably bubble free, that is, cavity free extraction, of a paste, in spite of being constructed in a simple and cost effective manner.

Through providing a drum follower plate with a tight upper plate and a lower grid plate connected to it, whose intermediary space can be evacuated, only through openings between the grid plate and the closed upper plate, thus normally only the grid openings, a passage of air or paste can occur.

When the drum follower plate is placed onto a surface of the paste with the grid plate facing downward, preferably completely covering the surface and abutting to the interior circumference of the container in a sealing manner, the grid plate initially only contacts rises in an uneven surface of the paste.

Thereby, some air filled cavities at the bottom of the grid plate will be created, which are completely enclosed by paste in circumferential direction and therefore are defined against each other and separated from each other.

By loading the drum follower plate with force in feed direction downward, thus into the container, and/or by evacuating the space between the closed upper plate and the grid plate with a vacuum connector, the air in these cavities, which are connected, due to the multitude of grid openings, with the intermediary space between the upper plate and grid plate, it is pressed upward into the intermediary space, so that after a while paste enters into the intermediary space from all grid openings, which can also be optically controlled well with a transparent upper plate.

As soon as paste enters into the intermediary space upwards, which can easily be seen with a transparent upper plate, this process could be terminated, since then it is assured that no air enclosures are present on the lower side of the grid plate from where the paste is pumped out through the follower plate.

As a precautionary measure, this is preferably continued until the whole intermediary space is filled with paste, which can be controlled in a simple manner—through connecting clear sight hoses or sight tubes to one or several vacuum connectors of the drum follower plate—and paste is to be seen there.

This process is performed before each pumping of paste out of the container and is preferably continued during the pumping process and, in particular, during the whole emptying process of the container even in moments when no pumping of paste is performed.

After emptying the container completely, the drum follower plate, whose intermediary space is at least partially filled with paste, is disposed of together with the container. Therefore the follower plate is made from plastic in an economical manner.

In order to enable or facilitate the described procedure, the upper plate and the grid plate are connected tight, glued, in particular, or integrally made in one piece, on the one hand at the external peripheral rim, and on the other hand especially over a pump wall, typically surrounding the central pump opening in a tight manner, bridging the elevation differential between the upper plate and the grid plate, onto whose upper end the pump, or its suction tube is imposed, for which a connecting device for tight imposition and for longitudinally fixed connection, at least in feed direction downward is provided, in order to load the drum follower plate in feed direction through loading the pump or the suction tube in feed direction.

The outer rim of the drum follower plate thereby is elastic in radial direction in order to attach to the interior circumference of the container in a tight manner, which has a constant, mostly round cross section along its extension from the top to the bottom.

The rim of the drum follower plate preferably is a circumferential rim protruding above the upper plate, expanding conically upwards and to the outside, whose elasticity is assured through the elastic properties of the plastic material of which the drum follower plate and thereby also its rim are made.

In order to assure that possibly any initial air inclusion between the surface of the paste and the grid plate are connected with at least one of the grid openings, the number of the grid openings is as big as possible, in particular larger than 100, or larger than 500, or even larger than 1000 or 2000. The distances of the grid openings from each other, this means the width of the rims in between, are as small as possible, this means at the most 30 mm, better at the most 20 mm, or at the most 10 mm.

The grid openings can be dot shaped, e.g. circular grid openings, or also longitudinal, in particular radially slotted grid openings, since it is not detrimental when the same grid opening is in connection with several separate air enclosures. In order to avoid the paste, which has seeped through the grid openings into the intermediary space of the follower plate, there again forms air enclosures, before the sucked in paste exits from the vacuum connector or from another overflow of the drum follower plate into the viewing hose (which can also suck out remaining air enclosures below the grid plate in the container) additional measures can be provided:

On the one hand, a vacuum loading could be performed from several locations so that air enclosed in one location is evacuated, while paste is already present at the other vacuum connector.

Furthermore, it is advantageous when the elevation differential between the upper plate and the grid plate is increased towards the vacuum connector or towards the overflow in order to avoid sealing between upper plate and grid plate before all the air is evacuated from the intermediary space.

This way, with a vacuum connector located close to the central pump opening, the elevation differential of the upper plate relative to the grid plate could increase in a conical manner from the upper rim towards the vacuum orifice typically located close to the middle.

The grid plate itself hereby can be provided as straight, thus flat, or rise in itself in a conical manner from the rim towards the middle in order to facilitate the advection of the paste to the pump opening through pressure onto the drum follower plate in feed direction, this means into the container downwards.

Since the drum follower plate cannot be reused together with the container after emptying the container, and thereby also the paste absorbed by the drum follower plate, its volume has to be kept as small as possible, and thereby also the free distance between the upper plate and the grid plate, which therefore should be less than 30 mm, in particular less than 20 mm or even less than 10 mm.

In order to increase the stability of the plate, in spite of it being made from plastic, the upper plate and the grid plate are ribbed between each other, also with vertical rims or other spacers supported against each other, wherein the rims extend preferably in a radial manner, whereby in particular they do not extend from the outer rim to the inner pump wall, transitioning into it, in order to establish a connection in circumferential direction between the otherwise developing single chambers, in particular next to the interior circumference, thus the pump wall.

In order to move the drum follower plate relative to the container, and in particular to be able to impart force into the container in feed direction, the emptying device also comprises a lifting device for lifting and also especially for lowering the container on the one hand, and the drum follower plate on the other hand, relative to each other.

For this purpose as up to now, the pump placed on the follower plate can be connected with the lifting device and both can be moved in a vertical direction relative to a fixed point, this means a carrier frame, while the container is standing still.

Preferably, however, the container is placed onto a carrier plate, movable relative to the carrier frame, with the consequence that the drum follower plate and the pump remain in place. This brings the advantage that all lines running to the drum follower plate and to the pump are not exposed to any movement and, thereby, the risk of them being damaged is reduced.

This is useful in particular since a whole array of sensors and thereby also electrical wires to the sensors are provided in addition to the known emptying devices in order to be able to better control and automate the emptying process.

On the one hand, an enclosing housing, in particular with a transparent door, is part of the emptying device. The housing is also helpful in reducing risk of injury to a user when to start the lifting device only the door is closed. Another advantage is that actively controlled temperature and humidity in the interior of the tight housing is provided according to the storage requirements of the paste with respect to these physical parameters.

In addition, a force sensor is useful to control the pressure of the drum follower plate into the paste and also a sensor for detecting the feeding velocity or feeding power off the pump, which is preferably controlled from the user side according to momentary requirements anyhow, in order to be able to perform plausibility checks between the sensed feed volume on the one hand and the lowering of the drum follower plate on the other hand, since in case both do not agree, it means that the paste has e.g. been pressed past the outer rim of the follower plate and thereby the impact pressure was too high, or on the other hand insufficient following of the plate due to insufficient feed pressure has occurred.

For the same reason, it is useful to constantly control the vacuum applied to the vacuum connector through a sensor, and possibly also the elevated pressure in the paste in the container, resulting from the impact pressure.

Also here the congruence with predetermined desired values can be controlled, wherein the determination of the desired values is performed depending on the viscosity of the paste, the design of the pump etc.

With respect to all parameters controlled through sensors, in case of too strong a deviation between desired values and actual values, or in case of a negative result of the plausibility comparisons, an alarm is given, leading to a manual check by an operator.

Since the emptying device has a control system which, besides moving the lifting device and possibly activating the vacuum, performs these comparisons, and possibly a storage unit for the measured values of the sensors and also the results of the comparisons, and/or a data port, the correct execution of the whole emptying process can be recorded and referenced or checked.

One of the advantages of the described emptying device is that in the flow path of the paste above the drum follower plate no additional air bleed valve is required, but this feed line can pass through, which not only reduces cost but also removes a source of malfunction.

Though in principle the design of the pump used in this emptying device is of secondary importance, the design of the scoop piston pump for pasteous materials shall be discussed, wherein a mushroom shaped scoop piston is vertically moved back and forth and thereby stroke by stroke paste is removed from the container, this means from the area in or below the drum follower plate, and fed upwards.

Since the drum follower plate is used as a disposable part, at the beginning of the emptying process of each new container the pump tube or suction tube has to be placed onto the pump opening of the drum follower plate and connected with it in a tight manner. This can be performed before or after evacuating the intermediary space of the drum follower plate:

When the evacuation is performed before the placement, the evacuation will preferably be performed manually through connecting the vacuum source with the vacuum connection of the drum follower plate until it is visible through optical control, that paste passes through all grid openings of the grid plate or one waits until in all sight hoses, connected to the existing vacuum connectors paste becomes visible.

The sight hoses thereby are provided long enough so that the vacuum loading only has to be finished, when in the pump opening of the drum follower plate which is still open towards the upper side, paste reaches up to a predetermined minimum level, preferably to the upper wall of the pump opening.

In case the evacuation is automatically performed through the control system, it will preferably only be performed after placing the pump or the suction tube onto the pump opening, and especially in this case it has to be assured, that also in the suction tube above or below the scoop cone no air enclosure remains.

Preferably a scoop piston pump is controlled in a manner, so that when the pump is stopped, the scoop piston always stops in a defined parking position relative to the pump housing, so that it is possible to provide a vacuum connector also at the suction tube, preferably below and/or above this parking position, and to evacuate also this part of the suction tube when the drum follower plate is being evacuated.

In case the evacuation process has to be performed automatically, controlled by the control system, preferably also the necessary optical control, either the passing of paste through all grid openings of the grid plate and/or paste reaching predetermined locations in all sight hoses—is also automatically controlled through sensors located in this spot:

Since also the feed force of the drum follower plate into the container is controlled, among other things depending on the viscosity of the paste, and the resulting pressure onto the paste, e.g. depending on the magnitude of the friction of the rim of the drum follower plate relative to the container, a reliable centering, also effective during the ongoing emptying, of the drum follower plate relative of the container shall be assured.

On the one hand this is performed through an initial insertion of the container into a centering device on the stand plate, e.g. the insertion between two stop rims having an angle between each other, which for control purposes also can be provided with a limit switch or a pressure sensor.

Since, in case the walls of the container are not completely vertical, the centering can degrade with the drum follower plate moving downwards, preferably a perpendicular direction motion device has to be provided, allowing a repositioning in both directions perpendicular to vertical, between the container on the one hand, and the drum follower plate on the other hand, possibly through a floating stand plate and/or a drum follower plate movable in perpendicular direction, through e.g. making the carrier arm, which holds the pump and the suction tube movable in perpendicular direction and also the drum follower plate in moved along, since it is solidly connected with the pump or the suction tube in perpendicular direction.

BRIEF DESCRIPTION OF THE SEVERAL VIEWS OF THE DRAWINGS

Embodiments according to the invention are now described in exemplary manner.

DETAILED DESCRIPTION OF THE INVENTION

Figure 1:
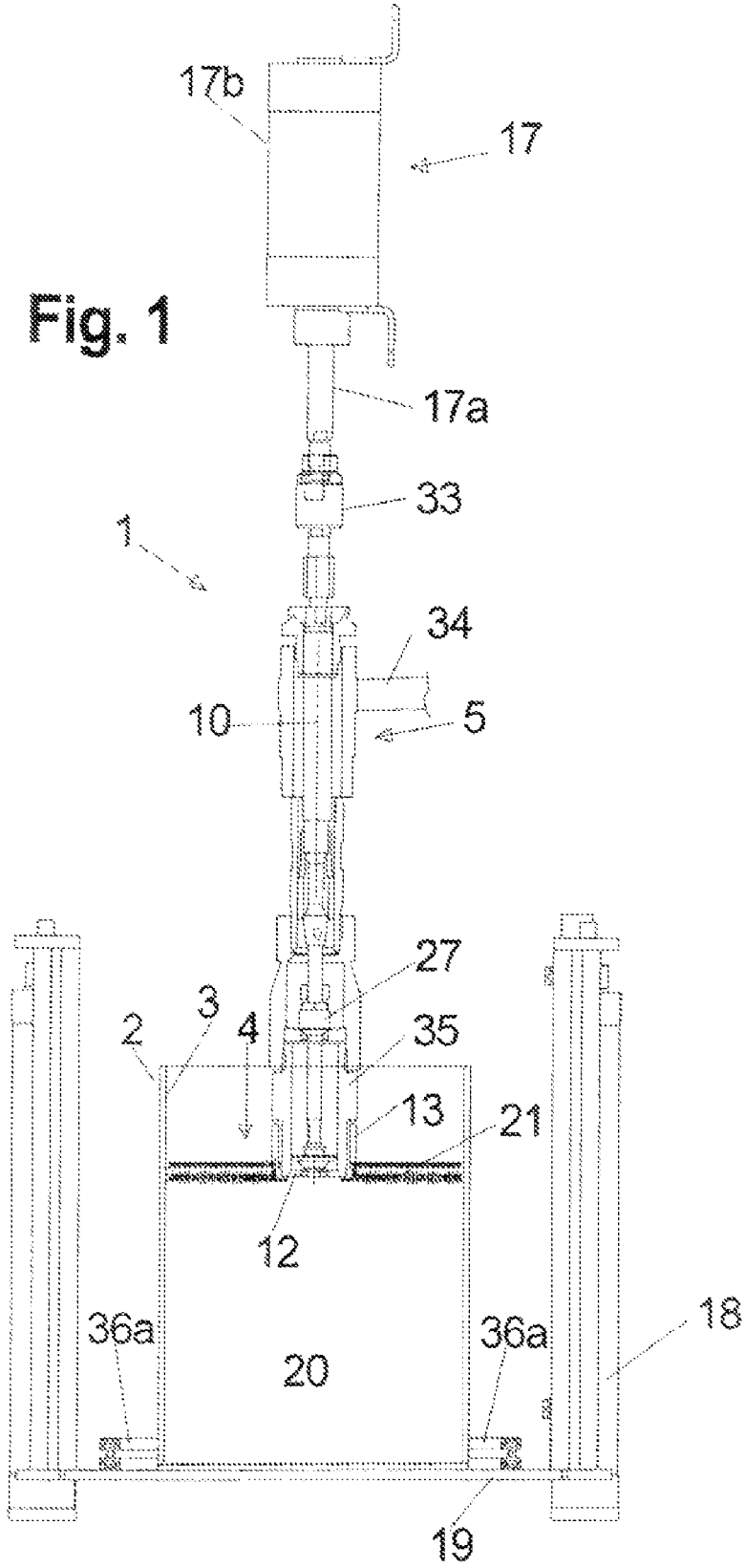
FIG. 1 shows a first embodiment of the emptying device.

FIG. 1 shows the emptying device 1, in a side view, for removing a paste 20 which is delivered in a barrel shaped container 2 with an interior cross section 3 constant over its height and mostly round.

For this purpose, a drum follower plate 4 is placed or pressed onto a surface 21 of paste 20, covering the whole surface 21 and abutting tight to interior cross section 3 of container 2.

Through a central pump opening 12 in follower plate 4, paste 20 is pumped out through a pump 5 whereby the volume of paste 20 in container 2 decreases. Follower plate 4 follows the descending surface 21 due to pressurization in feed direction 10, thus in axial direction into container 2.

Pump 5, in this case, is a scoop piston pump having scoop piston 27 that moves up and down in feed direction, in particular below surface 21 of paste 20, and thereby paste 20 is moved upward with each stroke into a suction tube 35 and from there further over pump 5 and is transported through suitable extraction lines 34 to one or several connected users.

Drum follower plate 4, in particular its pump wall 13 protruding upward around the central pump opening 12, is tightly connected with suction tube 35 of pump 5 which sits on pump wall 13 axially fixed in feed direction 10 and preferably also tight in perpendicular direction, being loaded with force in feed direction 10 through forward motion of suction tube 35 and pump 5, so that paste 20 is displaced upward into pump opening 12. In order to move pump 5 and suction tube 35 in feed direction, both are connected via a coupling 33 with a lifting device 17 provided as a pneumatic piston, which is located above pump 5 and coupling 33 and whose piston rod 17*a* protrudes vertically downward out of a cylinder 17*b*, which is mounted to a housing or carrier frame in a solid manner.

In order to make follower plate 4, which is positioned concentric with the motion axis of the piston rod 17*a*, exactly concentric with container 2, before the positioning of follower plate 4 the upwards open container 2 is placed onto, in this case, a stationary stand plate 19 which is connected to a carrier frame 18 and pushed into a container centering device 36 perpendicular to the feed direction 10, consisting of two angled stop beams 36*a,b* positioned on stand plate 19 in a defined manner, which have to be positioned depending on the used containers 2, in particular their outer diameter.

Drum follower plate 4 and further elements of emptying device 1 are already equipped according to the invention as described further below.

While in FIG. 1 the relative motion between follower plate 4 and container 2 is performed through lowering follower plate 4 through moving pump 5 and suction tube 35 pressing on it, FIG. 2 show a solution, whereby in reverse, follower plate 4 (which is not visible in FIG. 2 since it is inside container 2) as well as the connected pump 5 remain stationary, and instead container 2 is moved upward against the feed direction 10 through vertical motion of stand plate 19, on which container 2, again inserted into a container centering device 36, is placed.

For this purpose, stand plate 19 is vertically guided along a vertical corner columns of a carrier frame 18 and movable through a lifting device 17', comprising two pneumatic cylinders 17*b* attached onto opposing sides of stand plate 19. In order not to lose any height, these are located in the corner areas of the square stand plate 19 and protrude from the lower end position of stand plate 19 substantially upward, wherein the piston rod 17*a* extendable from the cylinder 17*b* presses against a bridge 42 extending above the cylinder 17*b* and connected with stand plate 19.

Next to one of the lifting devices 17' a distance measuring device 26 is located which determines the elevation of stand plate 19 at all times.

Figure 2A:
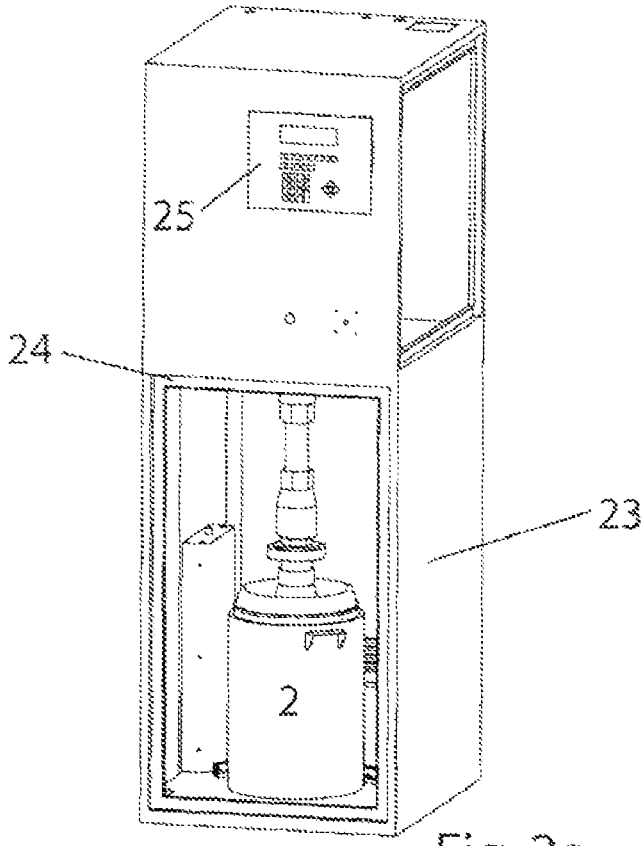
FIGS. 2*a-c* show a second embodiment of the emptying device.
Figure 2B:
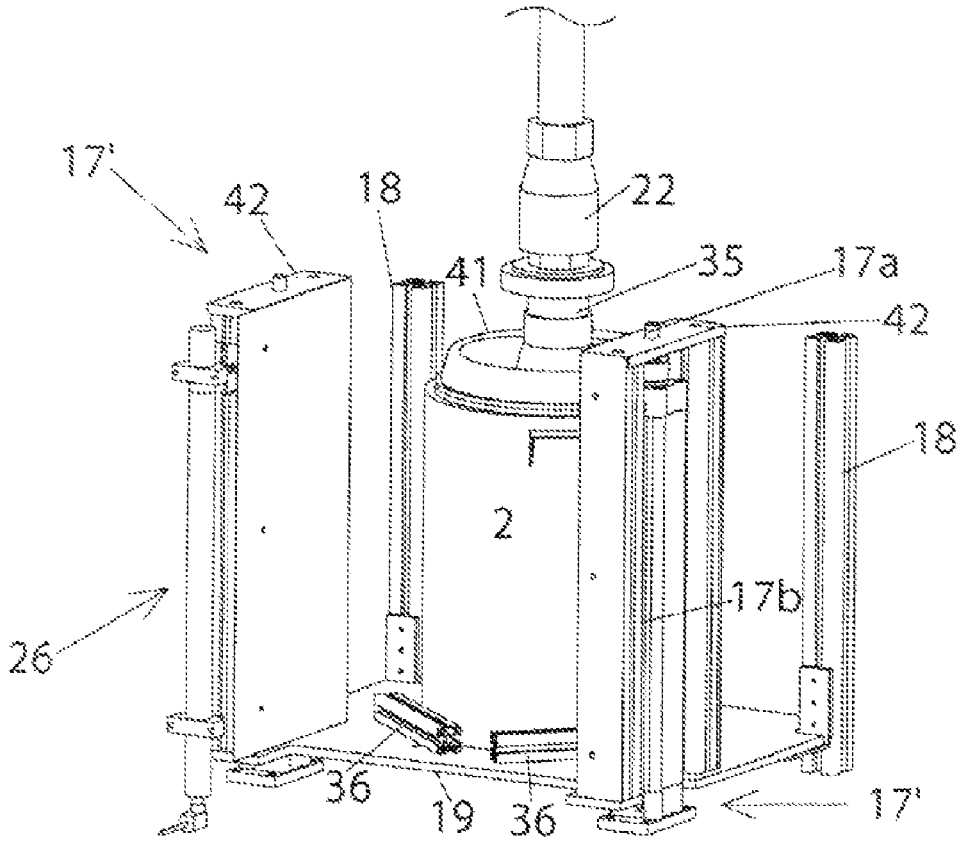
Figure 2C:
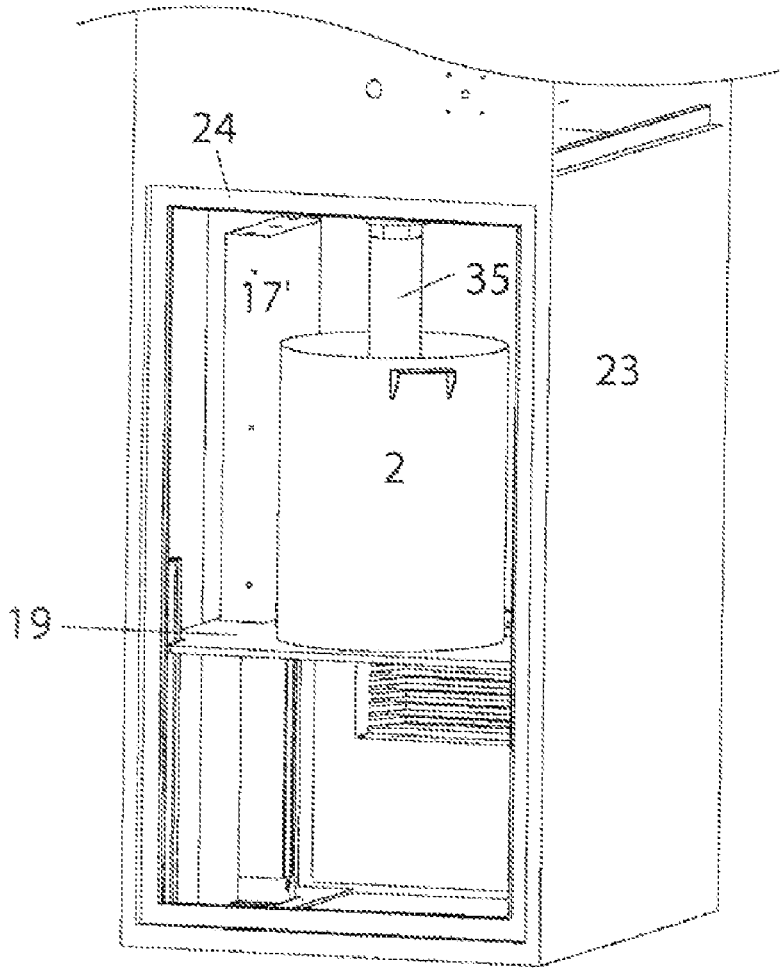

In FIGS. 2*a-c*, the load transfer from suction tube 35 to follower plate 4 is not performed directly but through a stable pressure plate 41, generally made of metal, substantially covering the whole surface of follower plate 4 from above so that follower plate 4 can be made as a disposable part from plastic with a relatively small internal stability and thereby inexpensive.

As FIGS. 2*a* and 2*c* show, emptying device 1 is located in an enclosed housing 23, shaped as a closet whose front door 24, which is necessary for changing container 2, has a sight window for optically controlling the correct emptying process. Housing 23, which is preferably created by tight plating of the stabilizing carrier frame 18, provides protection on the one hand against reaching into the emptying device during operation, which would pose the risk of injury through the parts moving relative to each other, and on the other hand, the ability to actively adjust and control the correct physical parameters like e.g. pressure, temperature, and humidity for the paste to be handled in the interior of container 2. This is important in particular with pastes hardening through humidity and/or temperature as they are used for sealants and glues. In addition, all functional parts of the emptying device, in particular the user interface for an electrical control 25, are housed within container 2, as well as all sensors necessary for controlling the emptying process, sensors for the above listed physical parameters of the atmosphere, on the other hand, also a force sensor for the force loading of container 2 and follower plate 4 against each other, and/or a pressure sensor for the pressure in the paste in container 2 and/or in suction tube 35 or extraction line 34, prevailing in paste 20.

Through controlling either the absolute values of these sensors and/or comparing the relative values, e.g. of the lifting velocity of stand plate 19 relative to the pumping power of the pump, the control of the emptying process can be documented, on the one hand, and automatically controlled on the other hand besides the manual-optical control, which primarily comprises that paste can exit above follower plate 4 and at the transitions between follower plate, suction tube 35, and pump 5.

The fixed mounting of suction tube 35 and possibly of pressure plate 41, as well as of the total assembly connected to it, as pump 5 and extraction lines 34 makes a movable design of all electrical wires and hoses for the media to be provided, running to these components, redundant and thereby considerably reduces the failure risk of the emptying device. The manufacturing effort to make stand plate 19 and its control movable via a distance measuring device 26, are negligible in comparison.

Figure 3A:
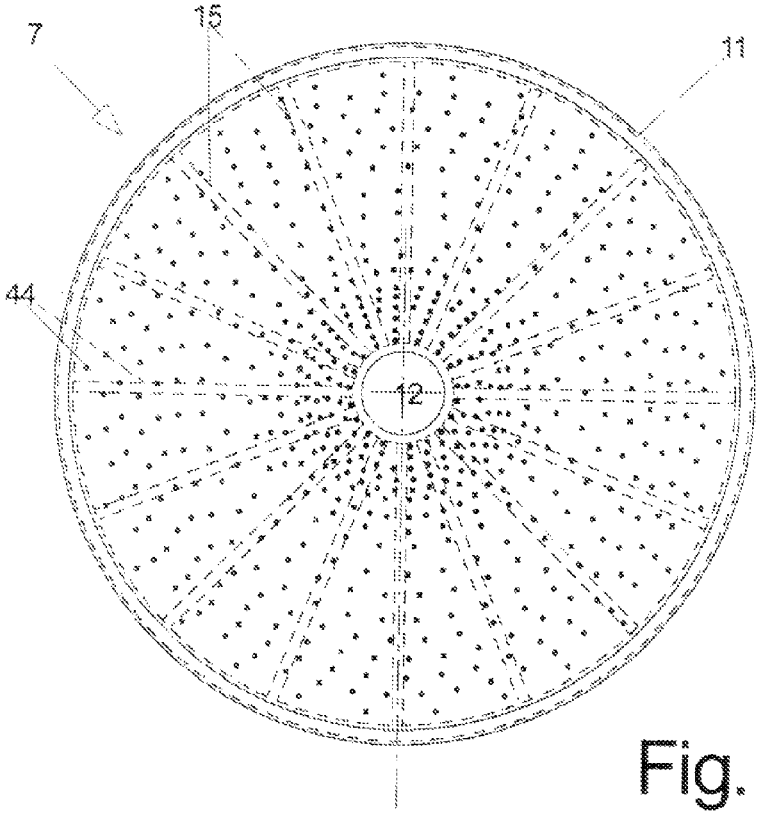
FIGS. 3*a-c* show the grid plate.
Figure 3B:
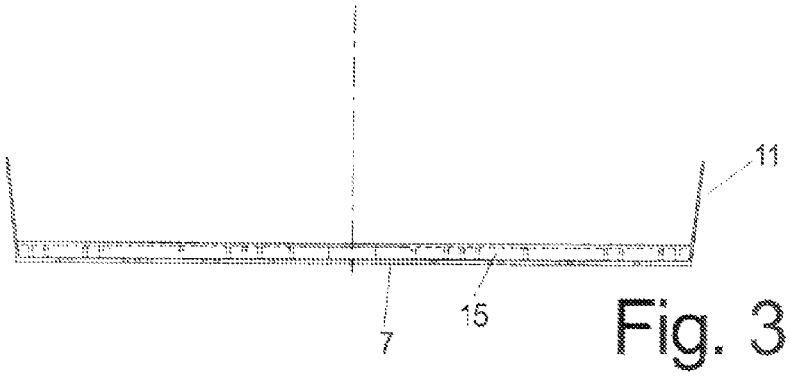
Figure 3C:
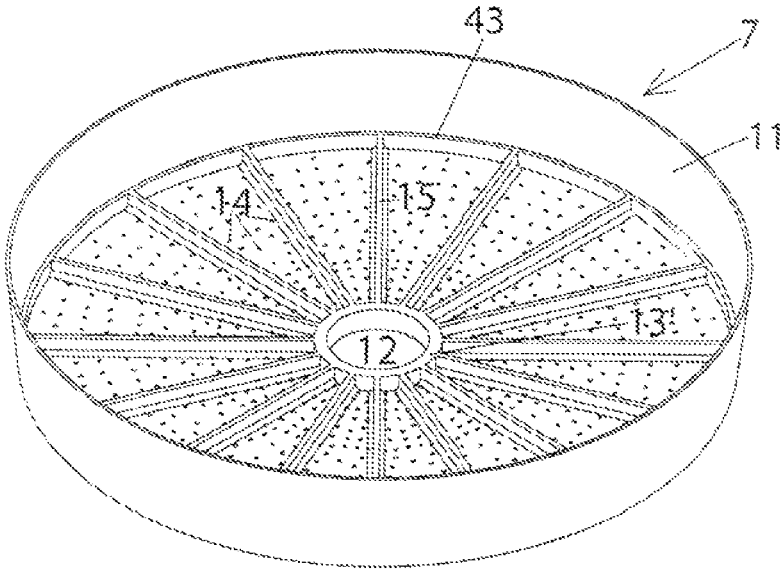
Figure 4A:
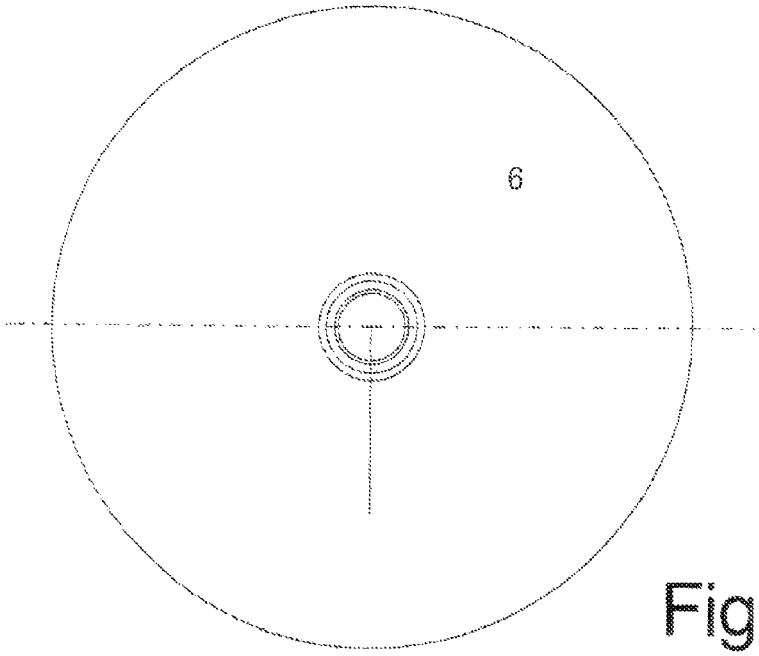
FIGS. 4*a-b* show the upper plate.
Figure 4B:
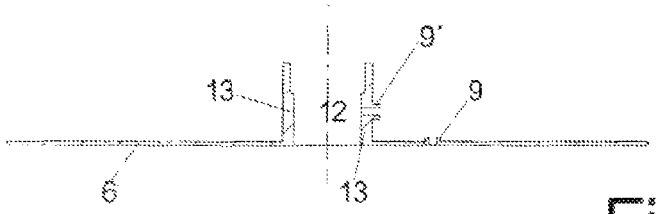

In FIGS. 3-5, the core piece of the emptying device according the invention is explained, in particular, the specially controlled drum follower plate 4.

Figure 5A:
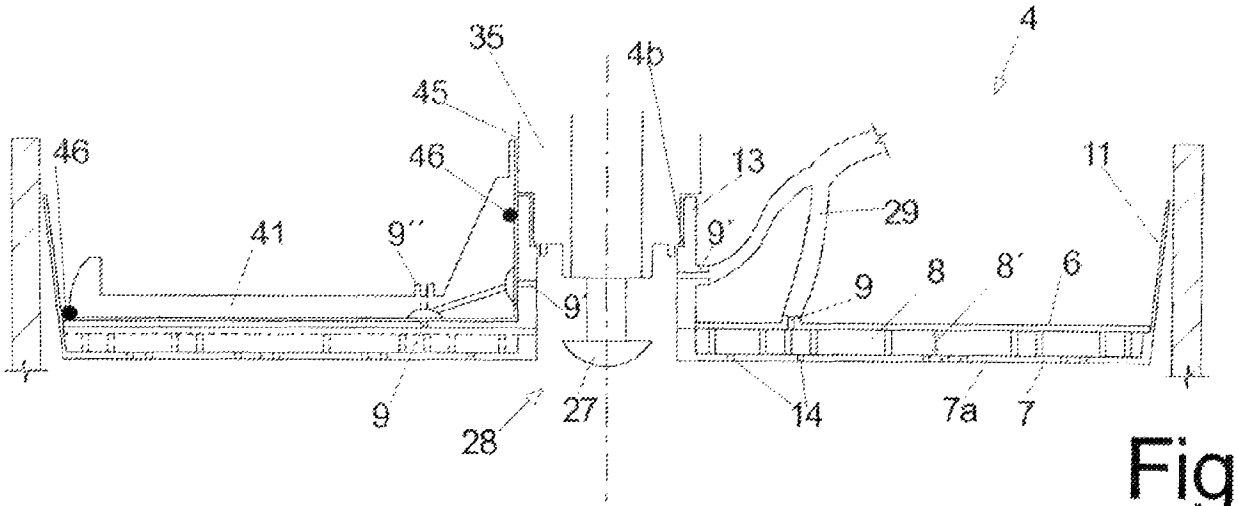
FIGS. 5*a-c* show the drum follower plate assembled from above.

As the vertical cut views of FIGS. 5*a* and *b* show, drum follower plate 4, which is typically circular in a top view, is made in two layers from two injection molded plastic parts which are connected tightly amongst each other, glued in particular.

On the one hand, a lower grid plate 7 is shown in FIG. 3 perforated by a multitude of small round grid openings 14 and distributed over the whole surface of grid plate 7, as well as by a central large pump opening 12.

From the outer rim of grid plate 7, a circumferential rim 11 protrudes upward, whose outer perimeter conically expands upward with a shallow slant angle of approximately 3°-10° relative to vertical, wherein the thickness of the material of rim 11 is sized in a manner that rim 11 with its freely extending upper end can attach itself elastically to the interior cross section 3 of container 2.

Grid plate 7 is stiffened by star-shaped stiffening ribs 15 located on its top surface, ending at the same elevation as a circumferential shoulder 43 in the interior circumference of rim 11 and an annular enclosed pump wall 13' surrounding pump opening 12.

FIG. 3*a* shows that ribs 15 do not pass through in radial direction but have pass through holes 44 between the areas separated from each other by the ribs, which were left out in the perspective drawing in FIG. 3*c* in order to simplify the illustration.

Onto to shoulder 43 and onto the upper face surface of the pump wall 13', subsequently, a fitting upper plate 6 is placed and glued or welded, as shown in FIG. 4.

Upper plate 6 corresponds with its exterior diameter to the interior diameter of the rim 11 and is closed, besides an also present, equally sized central pump opening 12, from which a pump wall 13 protrudes upwards.

Figure 5B:
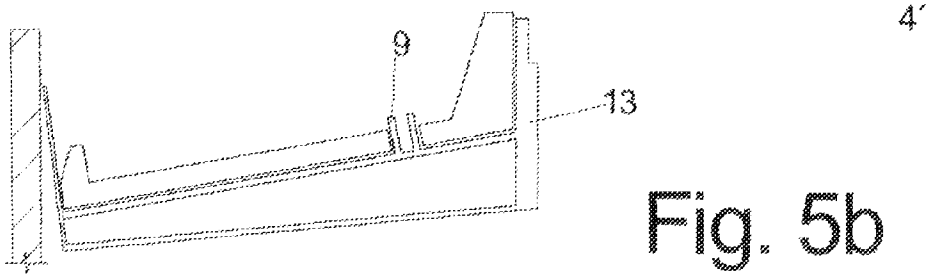
Figure 5C:
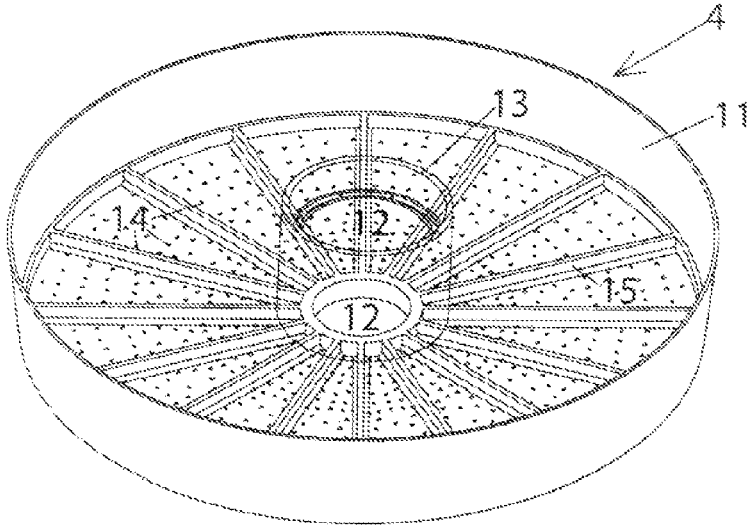

Through tight connection of the preferably clear upper plate 6 with grid plate 7, drum follower plate 4 or 4' is created, which is shown in a longitudinal cut view in FIGS. 5*a* and *b*, here from the variant according to FIG. 5*a* is shown in a three dimensional view in FIG. 5*c*.

FIG. 5 shows an enclosed intermediary space 8 with a distance 8' between the plates, thus created between upper plate 6 and grid plate 7, through at least one spout-shaped vacuum connector 9 protruding from the upper plate 6. In addition, pump opening 12 in the area of pump wall 13 can also have an opening through a vacuum connection 9', open towards the side.

Thus, when follower plate 4, placed onto surface 21 of paste 20 tightly abuts to the interior circumference of container 2 with its rim 11 and pump opening 12 is tightly closed through the imposed suction tube 35 and connected pump 5, or closed tight by another means, through applying vacuum at the vacuum connector 9, on the one hand, initially the air enclosed below follower plate 4 can be evacuated and thereby the surface of paste 20 flattened, which is successfully completed when paste 20 enters through all grid openings 14 into intermediary space 8.

Through further vacuum application, intermediary space 8 is completely filled with paste as well as grid openings 14. The pass-through holes 44 in ribs 15 are sized sufficiently large for passing through paste 20 with the applied vacuum.

When the whole intermediary space 8 is filled with paste 20, the paste will also exit out of the vacuum connector 9 into a connected sight hose 29, which is preferably transparent like upper plate 6 and which is used as a disposable part together with follower plate 4.

As FIG. 5*a* shows, grid plate 7 and upper plate 6 can be provided as flat, thereby also the lower side 7*a* of the grid plate 7 can form a flat surface.

FIG. 5*b*, on the other hand, shows an embodiment wherein, on the one hand, grid plate 7, and thereby also its bottom surface, slightly rises from the outer rim towards the middle in a conical manner, preferably at an angle of 5°-15°. Hereby, the displacement of paste 20 in container 2 towards the middle pump opening 12 is supported.

In addition and/or instead, the distance 8' between upper plate 6 and grid plate 7 can also be varied and increases in one direction, e.g. from the outer rim to the central pump wall 13 or versa, and the vacuum connector 9 can thereby be located in the area of the largest distance 8'.

Thereby, it is avoided that paste exists from the vacuum connector 9 before the intermediary space 8 is completely filled with paste, which minimizes the risk of air enclosures remaining below follower plate 4.

In addition FIG. 5*a*, on it left side, shows loading of follower plate 4 in feed direction 10 through suction tube 35, via a pressure plate 41, which—formed as a turned part made from metal, aluminum in particular—covers and loads substantially the whole upper surface of follower plate 4, so that the follower plate itself can be manufactured with less internal stability.

In order to keep the vacuum connectors 9 or 9' of follower plate 4, protruding upwards in direction of pressure plate 21, accessible, pass-through holes are left open at the respective locations of pressure plate 41, preferably extending around the center of pressure plate 41 over a large angular area in kidney shape, in order not to have to maintain an exact rotating position between pressure plate 41 and follower plate 4. Pressure plate 41 is preferably connected to suction tube 35 via a thread 45 in a solid manner.

Instead of connecting vacuum connectors 9, 9' of follower plate 4 through pressure plate 41, it is also possible to seal pressure plate 41 e.g. via circumferential seals at the interior circumference and the outer circumference of the pressure plate like e.g. O-rings 46, relative to the upper side of follower plate 4, and to provide the pressure plate 41 itself with a vacuum connector 9", connected with respective grooves in the lower side or the interior side of pressure plate 41, corresponding to vacuum connectors 9 and 9' of the follower plate 4.

This facilitates the placement of pressure plate 41 onto follower plate 4 and the application of vacuum, but has the disadvantage that in case of sucking paste 20 into vacuum connector 9" of pressure plate 41 this reusable pressure plate 41 has to be cleaned in a time consuming manner, and in addition there are no further sight controls possible for the filling of the total intermediary space 8 through paste 20.

FIG. 5*a*, furthermore, shows scoop piston 27 (when using a scoop piston pump as pump 5) moving up and down within pump opening 12, resting in a parking position 28, which it generally occupies when the pump stands still.

If scoop piston 27 is designed so that—at least in its parking position 28—it can tightly abut to the interior circumference of pump wall 13, also through the means of paste 20 adhering to piston 27—preferably also in pump wall 13, thus at a location above scoop piston 27, located in its parking position 28, a vacuum connector has to be provided, in order to be able to remove air present at this location at the beginning of the emptying process.

Vacuum connectors 9, 9' can be connected via a Y-shaped sight hose of sufficient length with the same vacuum source. A sufficient length of the sight hoses is necessary in order to avoid that in one branch of the sight hose no paste 20 is visible yet, while the other branch is filled with paste 20 to an extent that it is about to contaminate the fixed vacuum connector following behind the sight hose 29.

Furthermore, in FIG. 5, the shoulder 43' at the interior circumference of pump wall 13 is visible, which serves to attach suction tube 35 in a form tight manner in perpendicular direction.

The invention claimed is:

1. An emptying device for emptying pastes out of drum shaped containers, said device comprising:

a drum follower plate having an upper plate and a lower grid plate, spaced therefrom to form an intermediary space having a first vacuum connector; and a pump connected to a central opening of the drum follower plate;

said lower grid plate having a circumferential shoulder and radial stiffening ribs surrounding said central opening supporting said upper plate.

2. An emptying device according to claim 1 wherein said upper plate has a fluid tight connection with said grid plate.

3. An emptying device according to claim 1 including a pump wall between said pump opening and said intermediary space.

4. An emptying device according to claim 1 wherein said drum follower plate further includes an outer rim, elastic in a radial direction and protruding upward above said upper plate, conically expanding upward and surrounding in an annular manner.

5. An emptying device according to claim 1 wherein said grid plate has a multitude of grid openings.

6. An emptying device according to claim 5 wherein said grid openings are separated from each other with a maximum width of 30 millimeters between adjacent rims.

7. An emptying device according to claim 5 wherein said grid openings are separated from each other through rims with a maximum of 20 millimeters.

8. An emptying device according to claim 5 wherein said grid openings are separated from each other through rims with a maximum of 10 millimeters.

9. An emptying device according to claim 5 wherein a number of said grid openings is higher than 100.

10. An emptying device according to claim 5 wherein a shape of said grid openings is selected from the group consisting of longitudinal radially extending, and dot shaped; and each of said grid openings has the same shape.

11. An emptying device according to claim 1 wherein an elevation difference between said upper plate and said grid plate is a free distance of less than 30 millimeters.

12. An emptying device according to claim 1 wherein an elevation difference between said upper plate and said grid plate is a free distance of less than 20 millimeters.

13. An emptying device according to claim 1 wherein an elevation difference between said upper plate and said grid plate is a free distance of less than 10 millimeters.

14. An emptying device according to claim 1 wherein said drum follower plate is made from plastic.

15. An emptying device according to claim 1 wherein said upper plate includes a distance relative to said grid plate, changing in radial direction, increasing from an outside towards an inside, and said first one vacuum connector is located in the area of a largest distance.

16. An emptying device according to claim 1 wherein a bottom side of said grid plate rises from an outer rim towards said pump opening located in a center, in a slightly conical manner.

17. An emptying device according to claim 1 wherein said drum follower plate has a pump wall and further includes a connecting device for longitudinally connecting with said pump in an at least one direction.

18. An emptying device according to claim 1 wherein said drum follower plate further includes a second vacuum connector located on a pump wall.

19. An emptying device according to claim 18 wherein from each vacuum connector a transparent sight hose extends.

20. An emptying device according to claim 18 wherein a vacuum sensor is connected to each vacuum connector and located in said intermediary space.

21. An emptying device according to claim 1 wherein said first vacuum connectors is connected with a second vacuum connector.

22. An emptying device according to claim 1 wherein an extraction line passes above, thus downstream of, said pump.

23. An emptying device according to claim 1 further including a lifting device.

24. An emptying device according to claim 23 wherein said lifting device is for raising and lowering said emptying device relative to a fixed point.

25. An emptying device according to claim 23 wherein said lifting device is for lifting a stand plate, on which said drum shaped container stands, relative to a carrier frame.

26. An emptying device according to claim 23 wherein said lifting device includes a distance measuring device or a position measuring device.

27. An emptying device according to claim 23 wherein said lifting device is connected to a sensor for measuring a force of said drum follower plate pressing a paste.

28. An emptying device according to claim 23 wherein between said lifting device and said pump a coupling is located that can be decoupled.

29. An emptying device according to claim 1 further including an enclosed housing having a transparent door.

30. An emptying device according to claim 1 wherein said pump is a scoop piston pump having a second vacuum connector located above a parking position of the scoop piston in a pump wall.

31. An emptying device according to claim 1 wherein a velocity sensor is connected with said pump to measure its feeding velocity.

32. An emptying device according to claim 1 further including a control system that connects each sensor used with the device.

33. An emptying device according to claim 32 wherein said control system is capable to adapt a feed volume to the consumption of one or several simultaneously connected users.

34. An emptying device according to claim 32 wherein said control system further includes a data output and/or a storage unit for data from sensors utilized by said emptying device.

35. An emptying device according claim 1 further including a stand plate for said drum shaped container having a container centering device shaped as rearward stop rims, angulated relative to each other.

36. An emptying device according to claim 1 further including a temperature sensor and/or a humidity sensor within a housing.

* * * * *